US011098596B2

(12) United States Patent
Snider et al.

(10) Patent No.: US 11,098,596 B2
(45) Date of Patent: Aug. 24, 2021

(54) SYSTEM AND METHOD FOR NEAR WALL COOLING FOR TURBINE COMPONENT

(71) Applicant: General Electric Company, Schenectady, NY (US)

(72) Inventors: Zachary John Snider, Simpsonville, SC (US); Daniel Burnos, Greenville, SC (US); Lana Maria Osusky, Rexford, NY (US); Brian Gene Brzek, Clifton Park, NY (US); Gregory Thomas Foster, Greer, SC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 690 days.

(21) Appl. No.: 15/624,252

(22) Filed: Jun. 15, 2017

(65) Prior Publication Data

US 2018/0363470 A1 Dec. 20, 2018

(51) Int. Cl.
*F01D 5/18* (2006.01)

(52) U.S. Cl.
CPC ..... *F01D 5/187* (2013.01); *F01D 5/186* (2013.01); *F05D 2240/305* (2013.01); *F05D 2240/306* (2013.01); *F05D 2260/201* (2013.01); *F05D 2260/204* (2013.01)

(58) Field of Classification Search
CPC . F01D 5/187; F01D 5/186; F01D 5/18; F01D 5/181; F01D 5/182; F01D 5/183; F01D 5/188; F01D 5/189
USPC ..... 415/115
See application file for complete search history.

(56) References Cited

U.S. PATENT DOCUMENTS 4,056,332 A * 11/1977 Meloni ..... F01D 5/188 416/97 A
5,100,293 A * 3/1992 Anzai ..... F01D 5/186 416/96 A
5,624,231 A * 4/1997 Ohtomo ..... F01D 5/186 415/115
6,099,251 A * 8/2000 LaFleur ..... F01D 5/147 415/115
8,133,032 B2 * 3/2012 Tibbott ..... F01D 5/20 416/235
8,864,469 B1 * 10/2014 Liang ..... F01D 5/187 416/97 R
9,255,481 B2 * 2/2016 Lim ..... F01D 5/20
(Continued)

OTHER PUBLICATIONS

U.S. Appl. No. 15/152,684, filed May 12, 2016, Leary et al.
(Continued)

*Primary Examiner* — Juan G Flores
(74) *Attorney, Agent, or Firm* — Fletcher Yoder, P.C.

(57) ABSTRACT

A turbine airfoil includes a leading edge, a trailing edge, a pressure side wall extending between the leading edge and the trailing edge, a suction side wall extending between the leading edge and the trailing edge, a cooling air supply cavity disposed within the turbine airfoil, and a near wall cooling cavity disposed within the turbine airfoil and fluidly coupled to the cooling air supply cavity to receive cooling air. In addition, the near wall cooling cavity partially extends along the suction side wall from adjacent the leading edge to a location more proximal the trailing edge. Moreover, the near wall cooling cavity provides near wall cooling to a high heat load region along the suction side wall.

20 Claims, 4 Drawing Sheets

(56) References Cited

U.S. PATENT DOCUMENTS

2014/0199177 A1* 7/2014 Propheter-Hinckley ..... B22C 9/103 416/97 R
2016/0362985 A1* 12/2016 Lacy ..... F01D 5/187

OTHER PUBLICATIONS

U.S. Appl. No. 15/152,690, filed May 12, 2016, Leary et al.
U.S. Appl. No. 15/152,698, filed May 12, 2016, Leary et al.
U.S. Appl. No. 15/152,707, filed May 12, 2016, Weber et al.
U.S. Appl. No. 15/239,930, filed Aug. 18, 2016, Weber et al.
U.S. Appl. No. 15/239,940, filed Aug. 18, 2016, Weber et al.
U.S. Appl. No. 15/239,968, filed Aug. 18, 2016, Weber et al.
U.S. Appl. No. 15/239,985, filed Aug. 18, 2016, Weber et al.
U.S. Appl. No. 15/239,994, filed Aug. 18, 2016, Leary et al.

* cited by examiner

SYSTEM AND METHOD FOR NEAR WALL COOLING FOR TURBINE COMPONENT

BACKGROUND

The subject matter disclosed herein relates to combustion turbine systems, and more specifically, to combustor and turbine sections of combustion turbine systems.

In a combustion turbine, fuel is combusted in a combustor section to form combustion products, which are directed to a turbine section. The components of the turbine of the turbine section expend the combustion products to drive a load. The combustion products pass through the turbine section at high temperatures. Reducing the surface temperature of the components of the turbine may allow for greater efficiency of the turbine section.

BRIEF DESCRIPTION

Certain embodiments commensurate in scope with the originally claimed subject matter are summarized below. These embodiments are not intended to limit the scope of the claimed subject matter, but rather these embodiments are intended only to provide a brief summary of possible forms of the subject matter. Indeed, the subject matter may encompass a variety of forms that may be similar to or different from the embodiments set forth below.

In one embodiment, a turbine airfoil includes a leading edge, a trailing edge, a pressure side wall extending between the leading edge and the trailing edge, a suction side wall extending between the leading edge and the trailing edge, a cooling air supply cavity disposed within the turbine airfoil, and a near wall cooling cavity disposed within the turbine airfoil and fluidly coupled to the cooling air supply cavity to receive cooling air. In addition, the near wall cooling cavity partially extends along the suction side wall from adjacent the leading edge to a location more proximal the trailing edge. Moreover, the near wall cooling cavity provides near wall cooling to a high heat load region along the suction side wall.

In another embodiment, a turbine airfoil includes a leading edge, a trailing edge, a pressure side wall extending between the leading edge and the trailing edge, a suction side wall extending between the leading edge and the trailing edge, and an impingement cavity disposed within the turbine airfoil adjacent to the leading edge. In addition, the impingement cavity receives air from outside the turbine airfoil through multiple diffuser holes disposed along the leading edge. Further, the impingement cavity extends from adjacent the leading edge adjacent the pressure side wall to a location adjacent the suction side wall that is more proximal the trailing edge, and the impingement cavity is fluidly coupled to an outer surface of the suction side wall and is configured to provide post-impingement air to provide film cooling around the turbine airfoil In a further embodiment, a turbine airfoil includes a leading edge, a trailing edge, a pressure side wall extending between the leading edge and the trailing edge, a suction side wall extending between the leading edge and the trailing edge, a cooling air supply cavity disposed within the turbine airfoil, a reuse cavity disposed within the turbine airfoil, and a cooling channel disposed within the turbine airfoil. In addition, the cooling air channel is fluidly coupled to both the cooling air supply cavity and the reuse cavity. Moreover, the cooling air channel partially extends along the suction side wall and partially extends along the pressure side wall.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION

One or more specific embodiments of the present subject matter will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present subject matter, the articles "a," "an," "the," and "said" are intended to mean that there are one or more of the elements. The terms "comprising," "including," and "having" are intended to be inclusive and mean that there may be additional elements other than the listed elements.

Combustion products (e.g. exhaust gas) directed from a combustor to a turbine may pass through the turbine at a high temperature. The temperature of the combustion product may be high enough to reduce the structural integrity of certain elements (e.g., metals with a low melting point). However, increasing the temperature of the combustion products may increase the efficiency of the combustion turbine system (e.g., gas turbine system). Therefore, it is desirable to provide a cooling system to the components of the turbine.

Accordingly, embodiments of the present disclosure generally relate to a system and method for cooling the components (e.g., turbine airfoil) of the combustion turbine system. That is, some embodiments include passages in the body of the components that allow air to flow through. These passages may also include openings on the surface of the components such that the air flowing into the passages may flow out of the components through the openings. The air flow through the passages may provide cooling (e.g., convective cooling) to the internal structure of the components. The air flow through the openings may provide a thin film of air on the outside surface of the components that provides cooling to the outside surface of the components.

Figure 1:
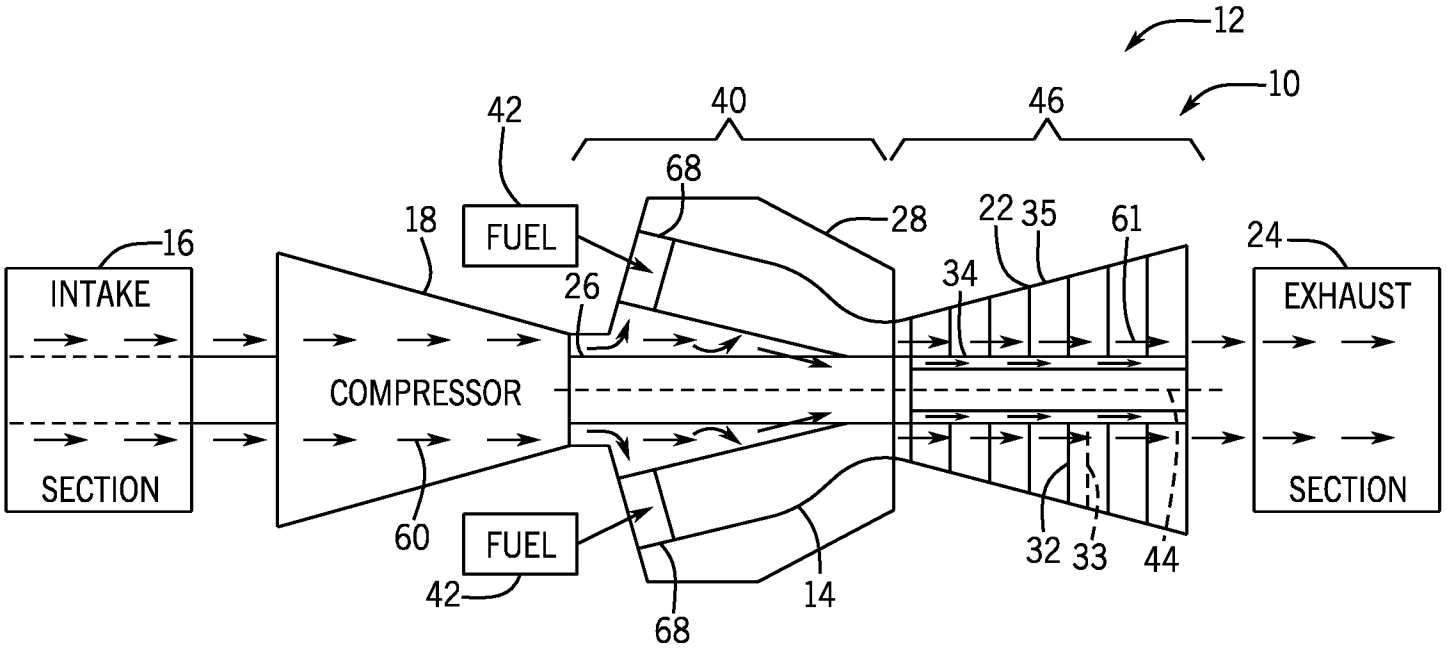
FIG. 1 is a diagram of an embodiment of a gas turbine system.

With the foregoing in mind, FIG. 1 is a block diagram of an example of a gas turbine system 10 that includes a gas turbine engine 12 having a combustor 14 and a turbine 22. In certain embodiments, the gas turbine system 10 may be all or part of a power generation system. In operation, the gas turbine system 10 may use liquid or gas fuel 42, such as natural gas and/or a hydrogen-rich synthetic gas, to run the gas turbine system 10. In FIG. 1, oxidant 60 (e.g. air) enters the system at an intake section 16. The compressor 18 compresses oxidant 60. The oxidant 60 may then flow into compressor discharge casing 28, which is a part of a combustor section 40. The oxidant 60 may also flow from the compressor discharge casing 28 into the turbine 22 through a passage 34 disposed about a shaft 26 or another passage that allows flow of the oxidant 60 to the turbine 22. The combustor section 40 includes the compressor discharge casing 28 and the combustor 14.

Fuel nozzles 68 inject fuel 42 into the combustor 14. For example, one or more fuel nozzles 68 may inject a fuel-air mixture into the combustor 14 in a suitable ratio for desired combustion, emissions, fuel consumption, power output, and so forth. The oxidant 60 may mix with the fuel 42 in the fuel nozzles 68 or in the combustor 14. The combustion of the fuel 42 and the oxidant 60 may generate the hot pressurized exhaust gas (e.g., combustion products 61). The combustion products 61 pass into the turbine 22. The combustor section 40 may have multiple combustors 14. For example, the combustors 14 may be disposed circumferentially about a turbine axis 44. Embodiments of the gas turbine engine 12 may include 1, 2, 3, 4, 5, 6, 7, 8, 9, 10, 11, or 12 or more combustors 14.

A turbine section 46 includes the turbine 22 that receives the combustion products 61 and turbine blades 32 (e.g., turbine airfoils). The turbine blades 32 are coupled to the shaft 26 and extend towards a turbine casing 35 with a height 33. The combustion products 61 may drive one or more turbine blades 32 within the turbine 22. For example, the combustion products 61 (e.g., the exhaust gas) flowing into and through the turbine 22 may flow against and between the turbine blades 32, thereby driving the turbine blades 32 into rotation. Because the turbine blades 32 are coupled to the shaft 26 of the gas turbine engine 12, the shaft 26 also rotates. In turn, the shaft 26 drives a load, such as an electrical generator in a power plant. The shaft 26 lies along the turbine axis 44 about which turbine 22 rotates. The combustion products 61 exit the turbine 22 through an exhaust section 24.

Figure 2:
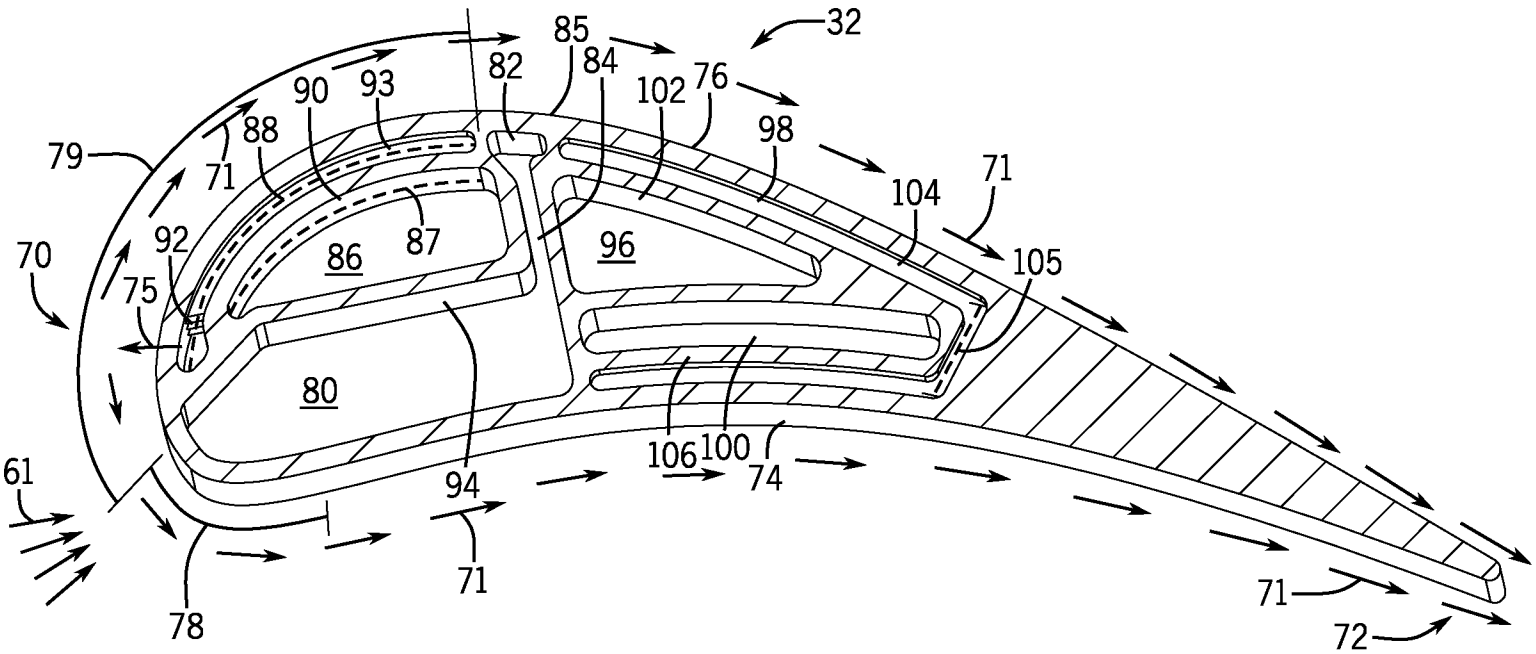
FIG. 2 is a cross-section of a first embodiment of a turbine blade of the gas turbine system of FIG. 1.

FIG. 2 is a cross-section of an embodiment of one of the turbine blades 32 (e.g., turbine airfoils) in the turbine section of FIG. 1. As discussed above, the combustion products 61 flow against the turbine blade 32 to drive the turbine blade 32 into rotation. In operation, the combustion products 61 flow against the turbine blade 32 from a leading edge 70 to a trailing edge 72. The flow of the combustion products 61 along with the airfoil shape of the turbine blade 32 causes a pressure gradient across the turbine blade 32. For example, the pressure along a pressure side wall 74 that extends from the leading edge 70 to the trailing edge 72 is higher than the pressure along a suction side wall 76 that extends from the leading edge 70 to the trailing edge 72. It should be appreciated that portions of the leading edge 70 may be along the pressure side wall 74, the suction side wall 76, or both, and portions of the trailing edge 72 may be along the pressure side wall 74, the suction side wall 76, or both. Further, the flow of the combustion products 61 against the turbine blade 32 causes a high heat load region 79 along the suction side wall 76.

As the combustion gases 61 pass over the turbine blade 32, the combustion gases 61 transfer a portion of the heat to the turbine blade 32. Accordingly, the turbine blade 32 may utilize various structures and methods to dissipate the heat received from the combustion gases 61. In the present embodiment, thin film cooling is utilized to reduce the transfer of the heat of the combustion gases 61 to the turbine blade 32. Thin film cooling is the process of providing cool air (e.g., the oxidant from the compressor discharge casing) to the surface of the turbine blade 32. The cool air may be provided such that the cool air envelopes the surface of the turbine blade 32 and travels along a thin film cooling path 71. The thin film of cool air may provide cooling to the walls of the turbine blade 32 through conduction, convection, and blocking at least a portion of the combustion gases 61 from directly contacting the walls of the turbine blade 32. Further, the flow of the combustion gases 61 may disrupt this thin film of cool air and techniques described in detail below may maintain the thin film of cool air.

For example, the turbine blade 32 may include diffuser holes along a leading edge section 78. Diffuser holes are small holes formed in the surface of the turbine blade 32 that allow air to pass through in the form of 'jets' and provide a higher rate of convective heat transfer through impingement. In the present embodiment, the diffuser holes allow air to flow from outside the turbine blade 32 into an impingement cavity 80. The air flowing through the diffuser holes and into the impingement cavity 80 may include some of the cool air that forms the thin film and provide cooling to the surface and internal structure of the turbine blade 32. After the air flows into the impingement cavity 80, the air may flow out of the impingement cavity 80 through one or more holes in an impingement cavity surface 82.

Accordingly, the impingement cavity 80 extends, internal to the turbine blade 32, in one direction from the leading edge 70 to the trailing edge 72 and in another direction from the pressure side wall 74 to the suction side wall 76. In the present embodiment, the impingement cavity 80 includes a narrow passage 84 that allows the air to flow through the diffuser holes into the impingement cavity 80, then out of the impingement cavity 80 through holes disposed on the impingement cavity surface 82 to the suction side 76. Air that flows through the diffuser holes may still be at a temperature lower than the combustion gases 61 and thus is still capable of providing cooling to the turbine blade 32. Allowing the air to flow out of holes in the impingement cavity surface 82 may provide cooling to the suction side wall 76 of the turbine blade 32 and may maintain the thin film along the surface of the turbine blade 32. Accordingly, the holes may be located at a location 85 to allow the air to flow through a thin film entrance path 73 where the air joins the thin film cooling path 71. Further, in other embodiments, the impingement cavity surface may extend further along the suction side towards either the leading edge 70 or the trailing edge 72.

In the present embodiment, the turbine blade 32 employs further structure to provide cooling. For example, the turbine blade 32 includes a cooling air supply cavity 86. The cooling air supply cavity 86 may be fluidly coupled to the compressor discharge casing and receive the oxidant from the compressor discharge casing. Further, the turbine blade 32 may include an impingement cavity wall 94 that extends from the leading edge 70 towards the trailing edge 72, and ends at the suction side wall 76. The impingement cavity wall 94 fluidly separates the impingement cavity 80 from the cooling air supply cavity 86 and the near wall cooling cavity 88. In addition, the turbine blade 32 includes a near wall cooling cavity 88 fluidly coupled to the cooling air supply cavity. The near wall cooling cavity 88 extends along the suction side wall from adjacent the leading edge 70 to a location 85 more proximal the trailing edge 72. In the present embodiment, the turbine blade 32 includes a cooling air supply wall 90 disposed between the cooling air supply cavity 86 and the near wall cooling cavity 88. The cooling air supply wall 90 may be integral to or part of the impingement cavity wall 94, and together, the cooling air supply wall 90 and the impingement cavity wall 94 define the cooling air supply cavity 86, and their combination forms a high C switch back cross-section shape (i.e., a shape with a curvature sufficient to travel from the leading edge 70 to another location along the pressure side wall 74, the suction side wall 76, or both). The cooling air supply wall 90 includes holes that fluidly couple the cooling air supply cavity 86 and the near wall cooling cavity 88. The holes may be disposed in any order along the cooling air supply wall 90, including along only a section closer to the trailing edge 72, only a section closer to the leading edge 70, along other sections, along a length 87 of the cooling air supply wall, or any combination thereof.

Further, the near wall cooling cavity 88 includes one or more holes along the suction side wall 76 that allows the cooling air to flow out of the turbine blade 32 along a thin film entrance path 75. Upon exiting the turbine blade 32, the cooling air flows into and becomes part of the thin film path 71. A portion of the cooling air may flow towards the leading edge 70 before flowing towards the trailing edge 72. In addition, the near wall cooling cavity 88 may include one or more internal dividers 92 (e.g., ribs) that are substantially perpendicular to the height of the turbine blade 32. In the present embodiment, the internal dividers 92 extend from the edge of the near wall cooling cavity 88 nearest the trailing edge 72 towards the leading edge 70, but do not extend all the way to the edge of the near wall cooling cavity 88 nearest the leading edge 70. In other embodiments, alternate geometries for the internal dividers 92 may be utilized. For example, the internal dividers 92 may extend completely across a length 93 of the near wall cooling cavity 88, the internal dividers 92 may extend partially across the length 93 of the near wall cooling cavity 88, the internal dividers 92 may extend partially across the length 93 of the near wall cooling cavity 88 to form a winding, s-shaped opening, etc.

In addition, the turbine blade 32 includes a second cooling air supply cavity 96 fluidly coupled to a cooling air channel 98 and a reuse cavity 100. The second cooling air supply cavity 96 may be fluidly coupled to the compressor discharge casing and receive the oxidant from the compressor discharge casing. Holes may be disposed on a channel wall 102 such that air flowing through the second cooling air supply cavity 96 may flow into the cooling air channel 98. The holes may be disposed in any suitable arrangement along the cooling air channel 98, including along only a portion of the wall closer to leading edge 70, only along a portion of the wall closer to the trailing edge 72, or any other suitable arrangement. Further, the cooling air channel 98 is disposed between the second cooling air supply cavity 96 and the suction side wall 76. In other embodiments, the cooling air channel 98 may be only partially between the second cooling air supply cavity 96 and the suction side wall 76, or not between the second cooling air supply cavity 96 and the suction side wall 76. In addition, the cooling air channel 98 includes internal dividers 104 (e.g., ribs) that extend along the length of the cooling air channel 98. In other embodiments, alternate geometries for the internal dividers 104 may be utilized. For example, the internal dividers 104 may extend completely across the length of the cooling air channel 98, the internal dividers 104 may extend partially across the length of the cooling air channel 98, the internal dividers 104 may extend partially across the length of the cooling air channel 98 to form a winding, s-shaped opening, etc.

The cooling air channel 98 begins at the location 85 proximal to the impingement cavity surface 82 and extends along the suction side wall 76 towards the trailing edge 72. Then the cooling air channel 98 extends across a width 105 of the turbine blade 32 from the suction side wall 76 to the pressure side wall 74, and then extends along the pressure side wall 74 towards the leading edge 70 and ends at a location proximal to the impingement cavity 80. It should be appreciated that the cooling air channel 98 may include other geometries. For example, the starting and ending locations may be further towards the trailing edge 72, the cooling air channel 98 may cross the body of the turbine blade 32 between the impingement cavity 80 and the second cooling air supply cavity 96 and the reuse cavity 100, the cooling air channel 98 may include multiple, fluidly separated channels, etc. In addition, the cooling air channel 98 may include holes along the suction side wall 76, the pressure side wall 74, or any combination thereof, and the holes may allow air passing through the cooling air channel 98 to enter the thin film along the outside surface of the turbine blade 32.

After the air has flowed through the cooling air channel 98, the air flows through holes disposed along a reuse wall 106 and into the reuse cavity 100. The holes may be disposed in any suitable arrangement along the reuse wall 106, including along only a portion of the wall closer to leading edge 70, only along a portion of the wall closer to the trailing edge 72, or any other suitable arrangement. Further, after air passes into the reuse cavity 100, the air flows back towards the shaft and out of the turbine blade 32. In the present embodiment, air flows into the turbine blade 32 via the second cooling air supply cavity 96, then flows into the cooling air channel 98, then flows into the reuse cavity 100, and exits the turbine blade. In other embodiments, the air may flow into the turbine blade 32 via the reuse cavity 100, and flow out of the turbine blade 32 through the second cooling air supply cavity 96. Further, the turbine blade 32 may not include the reuse cavity 100, and the air may exit the turbine blade through holes along the cooling air channel 98.

Figure 3:
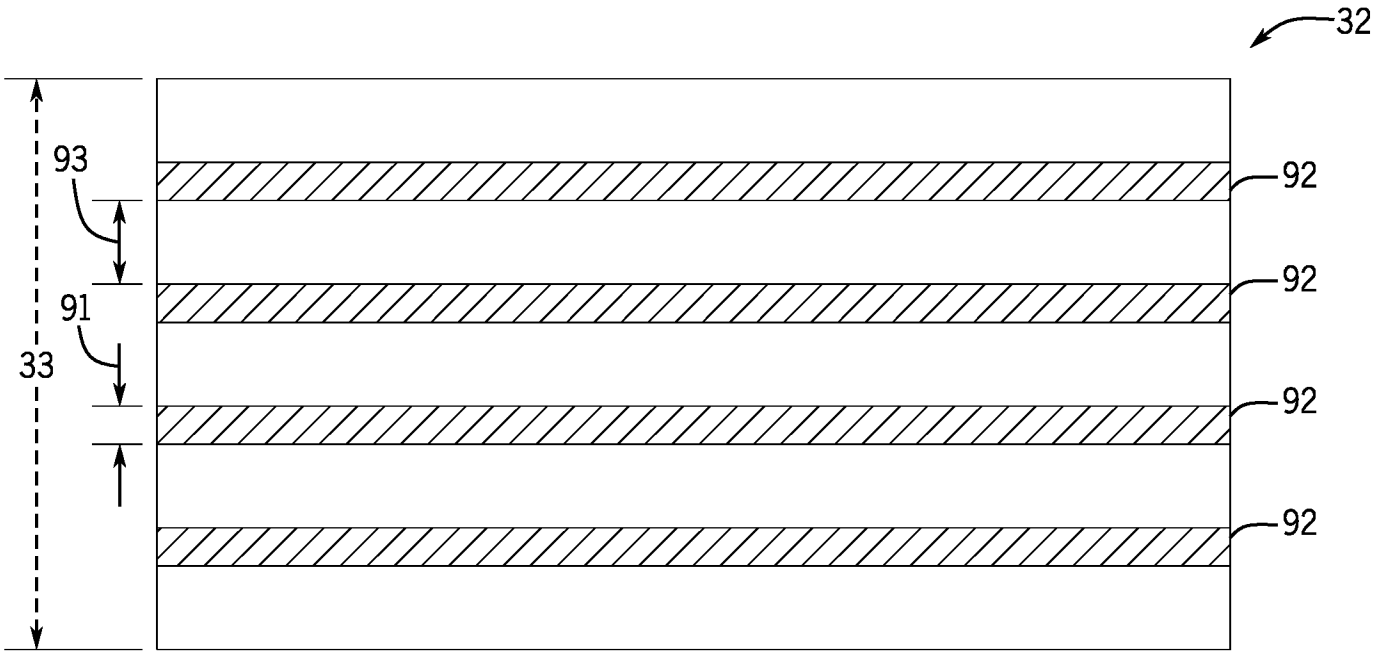
FIG. 3 is a cross-section of an embodiment of the turbine blade of FIG. 2 having internal dividers.

FIG. 3 illustrates a cross-section of an embodiment of the turbine blade 32 of FIG. 2 having internal dividers 92. As depicted, the internal dividers 92 are formed within the near wall cooling cavity 88. The internal dividers 92 extend transverse to the height 33 of the turbine blade. Further, the present embodiment includes four internal dividers 92; however, more or fewer internal dividers 92 may be included, including 1, 2, 4, 8, 16, 32 or more. In addition, each internal divider 92 has a width 91, and the width 91 of each internal divider 92 may vary or be the same. Further, a space 93 between each internal divider 92 may vary or be the same.

The internal dividers 92 are utilized to direct the flow of air in the near wall cooling cavity 88. For example, because the internal dividers 92 are substantially perpendicular to the height 33 of the turbine blade 32, the air is forced to flow substantially perpendicular to the height 33 as well. Further, directing the flow of the air may cause a more predictable flow and/or higher rate of heat transfer in the near wall cooling cavity 88.

Figure 4:
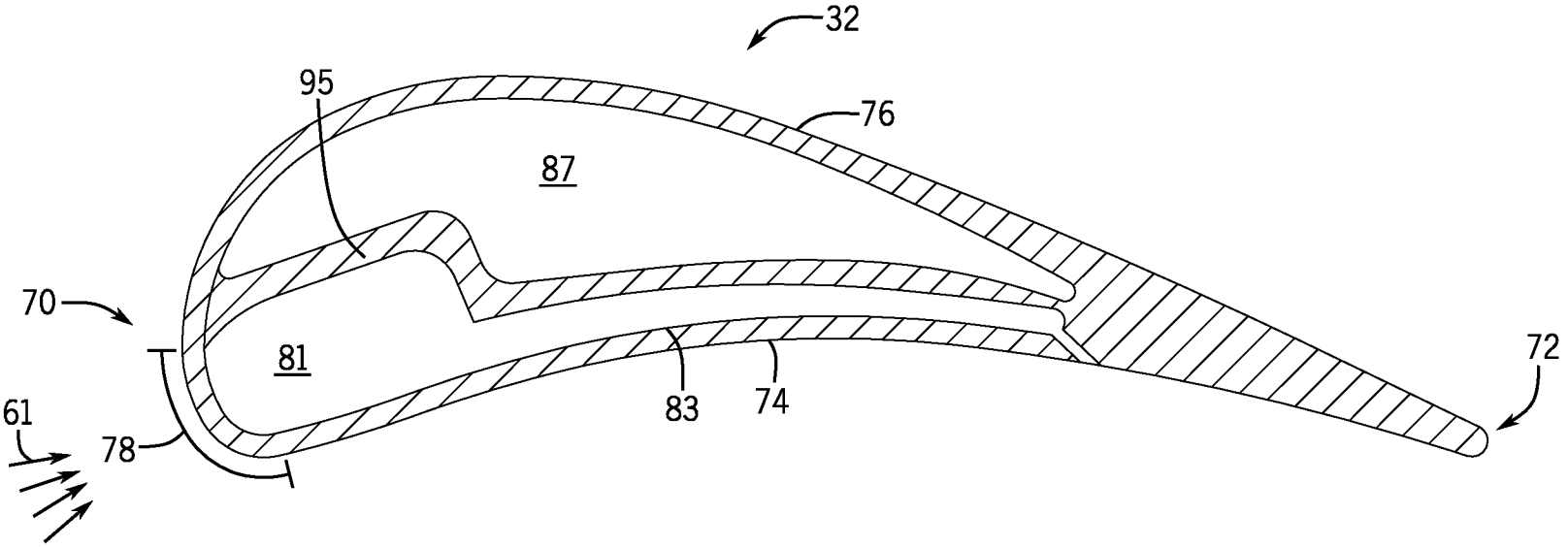
FIG. 4 is a cross-section of a second embodiment of a turbine blade of the gas turbine system of FIG. 1.

FIG. 4 illustrates a cross-section of an embodiment of the turbine blade 32. The turbine blade 32 may include diffuser holes along the leading edge section 78. Diffuser holes are small holes formed in the surface of the turbine blade 32 that allow air to pass through in the form of 'jets' and provide a higher rate of convective heat transfer through impingement. In the present embodiment, the diffuser holes allow air to flow from outside the turbine blade 32 into an impingement cavity 81. The air flowing through the diffuser holes and into the impingement cavity 81 may include some of the cool air that forms the thin film and provide cooling to the surface and internal structure of the turbine blade 32. After the air flows into the impingement cavity 81, the air may flow out of the impingement cavity 81 through one or more holes in an impingement cavity surface 83. In the present embodiment, the impingement cavity surface 83 extends along the pressure side wall 74 towards the trailing edge 72 and allows air to travel from the impingement cavity 81 and out of the turbine blade 32 through holes along the impingement cavity surface 83. The air that flows out of the holes along the impingement cavity surface 83 enters the thin film of air.

The present embodiment also includes a cooling air cavity 87 that may be fluidly coupled to the compressor discharge casing and receive the oxidant from the compressor discharge casing. Further, the cooling air cavity 87 extends from the leading edge 70 towards the trailing edge 72 between the impingement cavity 81 and the suction side wall 76. In addition, the cooling air cavity 87 includes a side wall 95 that fluidly separates the cooling air cavity 87 and the impingement cavity 81. Air that flows into the cooling air cavity 87 may flow out of the turbine blade 32 through holes disposed on the suction side wall 76. The holes disposed along the suction side wall 76 may be disposed in any suitable arrangement, including along only a portion of the wall closer to leading edge 70, only along a portion of the wall closer to the trailing edge 72, or any combination thereof. Air exiting the holes disposed along the suction side wall 76 may allow air exiting the cooling air cavity 87 to enter the thin film to provide additional cooling to the outside surface of the turbine blade 32.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A turbine airfoil, comprising:

a leading edge;

a trailing edge;

a pressure side wall extending between the leading edge and the trailing edge;

a suction side wall extending between the leading edge and the trailing edge;

a cooling air supply cavity disposed within the turbine airfoil;

a near wall cooling cavity disposed within the turbine airfoil and fluidly coupled to the cooling air supply cavity to receive cooling air, wherein the near wall cooling cavity has a first end and a second end, and wherein the near wall cooling cavity partially extends along the suction side wall from the first end adjacent the leading edge to the second end at a location more proximal the trailing edge, and the near wall cooling cavity is configured to provide near wall cooling to a high heat load region along the suction side wall; and an impingement cavity disposed within the turbine airfoil adjacent to both the near wall cooling cavity and the leading edge, wherein the impingement cavity is disposed along the pressure side wall and extends from adjacent the first end of the near wall cooling cavity to the suction side wall adjacent the second end of the near wall cooling cavity, and wherein the impingement cavity is configured to receive air from outside the turbine airfoil through a plurality of diffuser holes disposed along the leading edge.

2. The turbine airfoil of claim 1, wherein the near wall cooling cavity is fluidly coupled to an outer surface of the suction side wall and is configured to provide film cooling around the turbine airfoil.

3. The turbine airfoil of claim 1, wherein the near wall cooling cavity is curved along the suction side wall in a direction from the leading edge to the trailing edge.

4. The turbine airfoil of claim 1, comprising a wall disposed within the turbine airfoil extending from adjacent the leading edge to the location more proximal the trailing edge.

5. The turbine airfoil of claim 4, wherein the impingement cavity is fluidly coupled to an outer surface of the suction side wall and is configured to provide post-impingement air to provide film cooling around the turbine airfoil.

6. The turbine airfoil of claim 4, wherein the impingement cavity extends from adjacent the leading edge to the pressure side wall at a second location more proximal the trailing edge, and the impingement cavity is fluidly coupled to an outer surface of the pressure side wall and is configured to provide post-impingement air to provide film cooling around the turbine airfoil.

7. The turbine airfoil of claim 4, wherein the wall defines the cooling air supply cavity, the wall and the suction side wall together define the near wall cooling cavity, and the wall separates the cooling air supply cavity from both the impingement cavity and the near wall cooling cavity.

8. The turbine airfoil of claim 7, wherein a portion of the wall comprises a high C switch back cross-sectional shape along a plane transverse to a height of the turbine airfoil.

9. The turbine airfoil of claim 1, wherein the near wall cooling cavity comprises at least one internal divider that extends at least a portion of a length transverse to a height of the turbine airfoil of the near wall cooling cavity.

10. The turbine airfoil of claim 1, comprising a second cooling air supply cavity disposed within the turbine airfoil and between the cooling air supply cavity and the trailing edge, wherein the second cooling air supply cavity is configured to receive an air flow.

11. The turbine airfoil of claim 10, comprising a cooling air channel disposed within the turbine airfoil and fluidly coupled to the second cooling air supply cavity, wherein the cooling air channel partially extends along the suction side wall and partially extends along the pressure side wall.

12. The turbine airfoil of claim 11, comprising a reuse cavity disposed within the turbine airfoil and fluidly coupled to the cooling air channel, wherein the reuse cavity is configured to allow air to exit the turbine airfoil.

13. A turbine airfoil, comprising:

a leading edge;

a trailing edge;

a pressure side wall extending between the leading edge and the trailing edge;

a suction side wall extending between the leading edge and the trailing edge; and an impingement cavity disposed within and enclosed within a body of the turbine airfoil adjacent to the leading edge, wherein the impingement cavity is configured to receive air from outside the turbine airfoil through a plurality of diffuser holes disposed along the leading edge, and wherein the impingement cavity extends from adjacent the leading edge adjacent the pressure side wall to a location adjacent the suction side wall that is more proximal the trailing edge, and the impingement cavity is fluidly coupled to an outer surface of the suction side wall via holes in the suction side wall and is configured to provide post-impingement air to provide film cooling around the turbine airfoil.

14. The turbine airfoil of claim 13, comprising a first wall disposed within the body of the turbine airfoil extending from adjacent the leading edge to the location more proximal the trailing edge, wherein the first wall defines a cooling air supply cavity disposed within the body of the turbine airfoil, the first wall and the suction side wall together define a near wall cooling cavity disposed within the body of the turbine airfoil, and the first wall separates the cooling air supply cavity from both the impingement cavity and the near wall cooling cavity.

15. The turbine airfoil of claim 14, wherein a portion of the first wall comprises a high C switch back cross-sectional shape along a plane transverse to a height of the turbine airfoil.

16. The turbine airfoil of claim 13, comprising a cooling air supply cavity disposed within the body of the turbine airfoil; and a near wall cooling cavity disposed within the body of the turbine airfoil and fluidly coupled to the cooling air supply cavity to receive cooling air, wherein the near wall cooling cavity partially extends along the suction side wall from adjacent the leading edge to a location more proximal the trailing edge, and the near wall cooling cavity is configured to provide near wall cooling to a high heat load region along the suction side wall.

17. The turbine airfoil of claim 13, comprising a second wall disposed within the body of the turbine airfoil, wherein the second wall extends within the turbine airfoil from the pressure side wall to the suction side wall to partially define the impingement cavity.

18. A turbine airfoil, comprising:

a leading edge;

a trailing edge;

a pressure side wall extending between the leading edge and the trailing edge;

a suction side wall extending between the leading edge and the trailing edge;

a cooling air supply cavity disposed within a body of the turbine airfoil;

a reuse cavity disposed within the body of the turbine airfoil; and a cooling air channel disposed within the body of the turbine airfoil and fluidly coupled to both the cooling air supply cavity and the reuse cavity, wherein the cooling air channel partially extends along the suction side wall and partially extends along the pressure side wall;

a second cooling air supply cavity disposed within the body of the turbine airfoil; and an impingement cavity disposed within and enclosed within the body of the turbine airfoil adjacent to the leading edge, wherein the impingement cavity extends from a first location adjacent the leading edge adjacent the pressure side wall to a second location adjacent the suction side wall that is closer to the trailing edge than the first location, and the impingement cavity separates the cooling air supply cavity from the second cooling air supply cavity, and wherein the impingement cavity is configured to receive air from outside the turbine airfoil through a plurality of diffuser holes disposed along the leading edge.

19. The turbine airfoil of claim 18, wherein the reuse cavity is disposed between the cooling air channel and the cooling air supply cavity.

20. The turbine airfoil of claim 18, comprising a wall disposed within the body of the turbine airfoil, wherein the wall extends within the turbine airfoil from the pressure side wall to the suction side wall to partially define the impingement cavity, and wherein the second cooling air supply cavity and the impingement cavity are disposed on a first side of the wall, and wherein the reuse cavity, the cooling air supply cavity, and the cooling air channel are disposed on a second side of the wall opposite the first side.

* * * * *